US009864390B2

(12) United States Patent
Yang et al.

(10) Patent No.: US 9,864,390 B2
(45) Date of Patent: Jan. 9, 2018

(54) POWER SUPPLY SYSTEM AND POWER SUPPLY METHOD THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Zih-Min Yang, Taipei (TW); Ting-Hsi Huang, Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 230 days.

(21) Appl. No.: 14/831,319

(22) Filed: Aug. 20, 2015

(65) Prior Publication Data

US 2016/0334820 A1 Nov. 17, 2016

(30) Foreign Application Priority Data

May 11, 2015 (CN) ..... 2015 1 0237827

(51) Int. Cl.
*G05F 1/625* (2006.01)

(52) U.S. Cl.
CPC ..... *G05F 1/625* (2013.01)

(58) Field of Classification Search
USPC ..... 307/52
See application file for complete search history.

(56) References Cited

U.S. PATENT DOCUMENTS

2011/0191612 A1* 8/2011 Itakura ..... H02J 3/005 713/320
2011/0320796 A1* 12/2011 DeCusatis ..... G06F 1/206 713/2
2013/0249290 A1* 9/2013 Buonpane ..... G06F 1/3209 307/31

* cited by examiner

*Primary Examiner* — Jared Fureman
*Assistant Examiner* — Aqeel Bukhari
(74) *Attorney, Agent, or Firm* — Muncy, Geissler, Olds & Lowe, P.C.

(57) ABSTRACT

A power supply system and a power supply method thereof are disclosed. The power supply system includes a master power supply device and a slave power supply device. When a master power detection module detects that a current value of a master power signal generated from a master power supply module increases to a first loading proportion, a master micro-controlling module will notices a slave micro-controlling module via a controlling pin to enable a slave power supply module to generate a slave power signal. When a slave power detection module detects that a current value of the slave power signal decreases to a second loading proportion, the slave micro-control module will control the slave power supply module to stop generating the power signal.

10 Claims, 5 Drawing Sheets

POWER SUPPLY SYSTEM AND POWER SUPPLY METHOD THEREOF

BACKGROUND OF THE INVENTION

1. Field of the Invention

The present invention relates to a power supply system and a power supply method thereof; more particularly, the present invention relates to a power supply system and a power supply method thereof, for controlling a plurality of power supply device to turn on and off for rest.

2. Description of the Related Art

As the technology develops, many kinds of server systems also develop well. To provide power to the server system, it is an important issue to provide a power supply device for providing enough power to the current server system. The current power supply system may have many power supply devices to provide power at the same time in order to bear the maximum power requirement of the server system. But the server system does not always work with the maximum power requirement; therefore, the power supply system does not always need to provide such a great current. However, in the prior art, the power supply mechanism of the power supply system can only be completely turned on or off. The technology of respectively controlling a plurality of power supply devices cannot be achieved, unless using manpower to respectively and manually turn off the power supply device which is not required; therefore, it may easily cause the unnecessary waste.

Therefore, there is a need to provide a new power supply system and a power supply method thereof, to solve the disadvantage of the prior art.

SUMMARY OF THE INVENTION

It is an object of the present invention to provide a power supply system, for controlling a plurality of power supply device to turn on and off for rest.

It is another object of the present invention to provide a power supply method applied to the abovementioned power supply system.

To achieve the abovementioned object, the power supply system of the present invention is used for outputting a total power signal. The power supply system includes a master power supply device and a slave power supply device. The master power supply device includes a master power supply module, a master micro-controlling module, a master current equalizing module and a master power detection module. The master power supply module is used for providing a master power signal. The master micro-controlling module is used for controlling the master power supply module. The master power detection module is used for detecting a current value of the master power signal. The master current equalizing module is electrically connected to the master power supply module. The slave power supply device includes a slave power supply module, a slave micro-controlling module, a slave current equalizing module and a slave power detection module. The slave power supply module is used for providing a slave power signal. The slave micro-controlling module is electrically connected to the master micro-controlling module via a controlling pin, for controlling the slave power supply module; wherein when the master power detection module detects that the current value of the master power signal increase to the first loading proportion, the master micro-controlling module will notice the plurality of slave micro-controlling modules via the controlling pin, allowing the slave power supply module to provide the slave power signal. The slave power detection module is used for detecting the current value of the slave power signal; wherein when the slave power detection module detects that the current value of the slave power signal decreases to the second loading proportion, the slave micro-controlling module will control the slave power supply module to stop providing the slave power signal. The slave current equalizing module is electrically connected to the slave power supply module and the master current equalizing module; wherein the master current equalizing module and the slave current equalizing module are used for equalizing the current value of the master power signal and the current value of the slave power signal.

The power supply method of the present invention includes the following steps: providing a master power signal via the master power supply module; when detecting that the master power signal increases to a first loading proportion, providing a plurality of slave power signals via the plurality of slave power supply modules; equalizing a current value of the master power signal and the slave power signal; and when detecting that the current value of the plurality of slave power signals decreases to a second loading proportion, stopping the slave power supply module providing the slave power signal.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
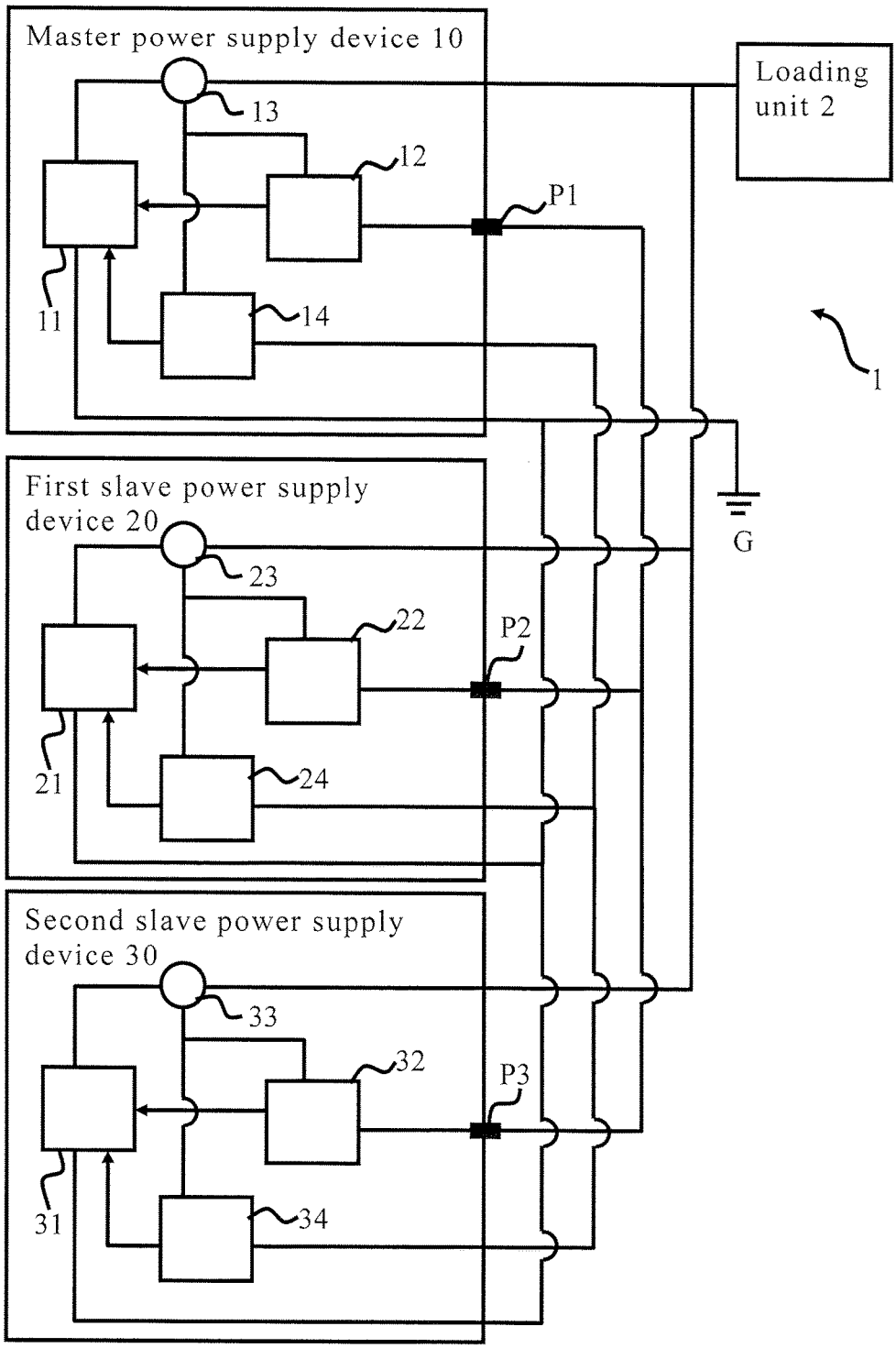
FIG. 1 illustrates a structure schematic drawing of the power supply system of the present invention.

Please refer to FIG. 1, which illustrates a structure schematic drawing of the power supply system 1 of the present invention.

The power supply system 1 of the present invention is used for outputting a total power signal to the loading unit 2, and the power supply system 1 includes a master power supply device 10 and a slave power supply device. In this embodiment, the slave power supply device includes a first slave power supply device 20 and a second slave power supply device 30, but the amount of the slave power supply device in the present invention is not limited to that design, the amount of the slave power supply device can be one or more. The master power supply device 10 of the present invention includes a master power supply module 11, a master micro-controlling module 12, a master power detection module 13 and a master current equalizing module 14. The first slave power supply device 20 includes a first slave power supply module 21, a first slave micro-controlling module 22, a first slave power detection module 23 and a first slave current equalizing module 24. The second slave power supply device 30 includes a second slave power supply module 31, a second slave micro-controlling module 32, a second slave power detection module 33 and a second slave current equalizing module 34.

The master power supply module 11 is used for providing a master power signal, the master power supply module 11 can be a module for connecting to the main supply or a module of an uninterruptible power supply for providing power, but the present invention is not limited to that design. The master micro-controlling module 12 is electrically connected to the master power supply module 11, for controlling the master power supply module 11 to be turned on or off, and to determine if the master power supply module 11 can output the master power signal. The master power detection module 13 is electrically connected to the master power supply module 11 and the master micro-controlling module 12, for detecting the size of the current value of the master power signal. The structure and the working method of the first slave power supply device 20 and the second slave power supply device 30 are the same as the master power supply device 10, which means that the first slave power supply module 21 and the second slave power supply module 31 respectively provide the first and the second slave power signal, the first slave micro-controlling module 22 and the second slave micro-controlling module 32 are respectively electrically connected to the first slave power supply module 21 and the second slave power supply module 31, for controlling the first slave power supply module 21 and the second slave power supply module 31 to be turned on or off. The first slave power detection module 23 and the second slave power detection module 33 are respectively electrically connected to the first slave power supply module 21 and the second slave power supply module 31, for detecting the current value of the first and second slave power signal outputted by the first slave power supply module 21 and the second slave power supply module 31. But the difference is that the master micro-controlling module 12 is further electrically connected to the first slave micro-controlling module 22 and the second slave micro-controlling module 32 via the controlling pin P1, P2, P3, allowing the master micro-controlling module 12 to control the first slave micro-controlling module 22 and the second slave micro-controlling module 32 via the controlling pin P1, P2, P3.

It is to be known that, the master power supply device 10, the first slave power supply device 20 and the second slave power supply device 30 need to be connected to a grounding end G, and the master power supply device 10, the first slave power supply device 20 and the second slave power supply device 30 also include other circuit elements (not shown in the figure). Because this part is not the key point of the present invention which needs to be improved, there is no need for further description. The abovementioned modules can be a hardware device, a software program, a firmware or a combination of those units, they can also be a circuit loop or other appropriate configuration; besides, each modules can be set as a single type, or a combination type. Besides, this embodiment is only used for describing a preferred example of the present invention; in order to give unnecessary details, the whole possible changes and combinations will not be described in detail. However, for people having the ordinary skill in this art of the present invention, the abovementioned modules or units may not be necessary. To implement the present invention, the invention may also include other details module or unit of the prior art. Each modules or units may be reduced or changed based on the requirement, and other module or unit may be installed between any two modules.

In the general case, first of all, the power supply system 1 uses the master power supply module 11 to provide the master power signal to the loading unit 2. When the power consumption requirement of the loading unit 2 increases, the current value of the master power signal of the master power supply module 11 will also increase. When the master power detection module 13 detects that the current value of the master power signal increases to a first loading proportion, the master micro-controlling module 12 will notice the first slave micro-controlling module 22 and the second slave micro-controlling module 32 via the controlling pin P1, P2, P3, allowing the first slave power supply module 21 and the second slave power supply module 31 to provide both the first and the second slave power signal. The master current equalizing module 14, the first slave current equalizing module 24 and the second slave current equalizing module 24 will work together, allowing the current value of the master power signal, the current value of the first slave power signal, and the current value of the first slave power signal to be the same. If the optimum efficiency range of the master power supply device 10, the first slave power supply device 20 and the second slave power supply device 30 is between 30% to 70% of the rated current loading proportion, the first loading proportion can be set to be 70% of the rated current loading proportion of the master power supply device 10, but the present invention is not limited to that design, it can also be 72% or 75%. Therefore, when the power consumption of the loading unit 2 increases, the first slave power supply module 21 and the second slave power supply module 31 will be able to provide power together, to reduce the loading of the master power supply module 11.

It is to be known that the master power supply device 10 further includes a master current equalizing module 14, and the first slave power supply device 20 and the second slave power supply device 30 further include a first slave current equalizing module 24 and a second slave current equalizing module 34. The master current equalizing module 14, the first slave current equalizing module 24 and the second slave current equalizing module 34 are electrically connected to each other, and electrically connected to the power supply modules which they belong to. When the master power supply module 11, the first slave power supply module 21 and the second slave power supply module 31 both provide the power, the master current equalizing module 14, the first slave current equalizing module 24 and the second slave current equalizing module 34 adjust the current value of the master power signal and the plurality of slave power signals, such that the current value of the master power signal and the plurality of slave power signals will be the same.

If the current value of the slave power signal decreases to the second loading proportion, which means that the power consumption of the loading unit 2 is not much. Thus the slave power signal will not be provided, and only the power supply module which is not turned off keeps providing the power signal to the loading unit 2.

In the first embodiment of the present invention, the first slave power detection module 23 and the second slave power detection module 33 automatically detect if their own slave power signals decrease to the second loading proportion according to the time interval, wherein the time interval can be 0.1 second, the second loading proportion can be 30% of the rated current loading proportion, but the present invention is not limited to that design, it can also be 28% or 26%. At the 0.1 second after the first slave power supply module 21 and the second slave power supply module 31 start, the first slave power detection module 23 will determine if the current value of the its outputting first slave power signal decreases to the second loading proportion. If it has decreased to the second loading proportion, the first slave micro-controlling module 22 will turn off the first slave power supply module 21.

Similarly, after another 0.1 second, if the second slave power detection module 33 determines that the current value of its outputting second slave power signal has decreased to the second loading proportion, the second slave micro-controlling module 32 will turn off the second slave power supply module 31.

Similarly, if the power supply system 1 only has a single slave power supply device, when the current value of the outputting slave power signal has decreased to the second loading proportion, the slave power supply module will be turned off.

Figure 2:
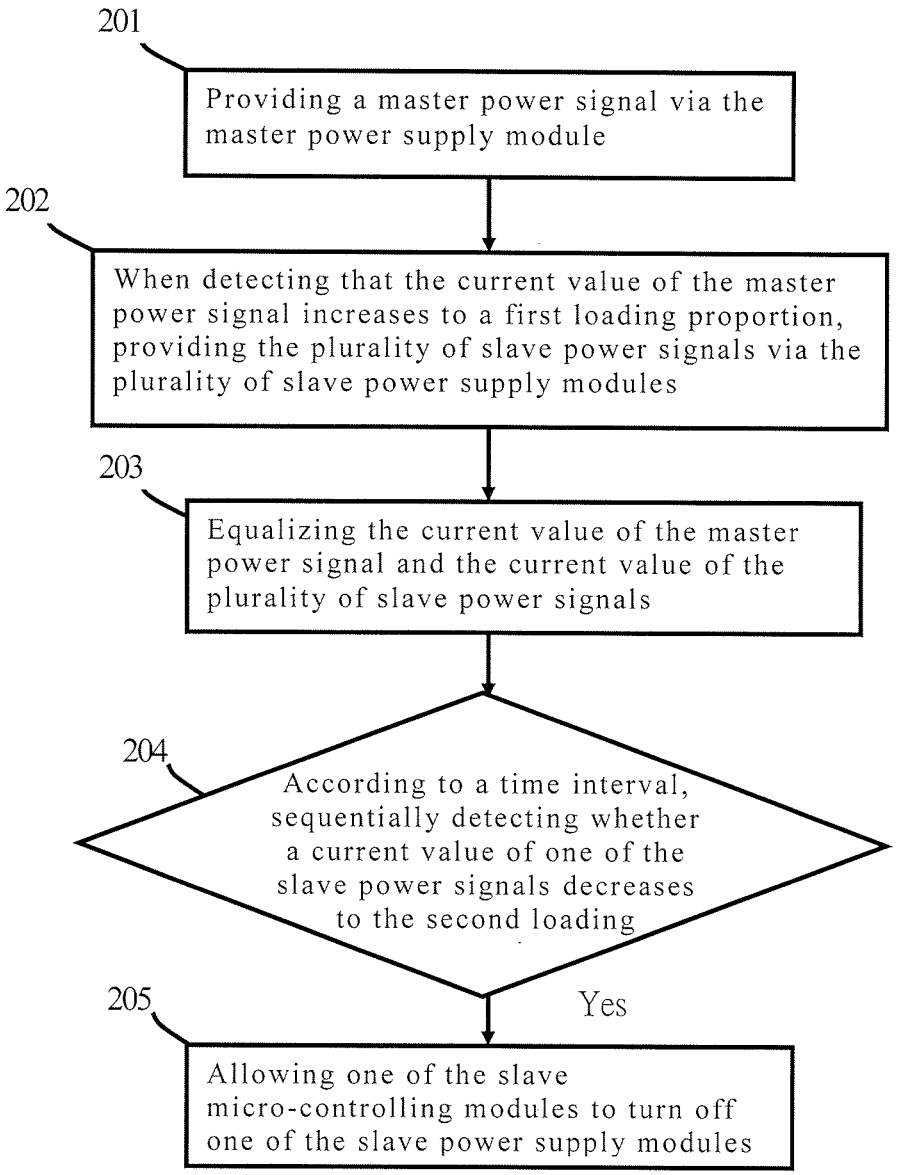
FIG. 2 illustrates a flowchart of the power supply method in the first embodiment of the present invention.

Please refer to FIG. 2, which illustrates the flowchart of the power supply method in the first embodiment of the present invention. It is to be known that, although the following description takes the abovementioned power supply system 1 as an example to describe the power supply method of the present invention, but the power supply method of the present invention is not limited to be applied to the power supply system 1 of the same structure as the abovementioned description.

First, performing Step 201: providing a master power signal via the master power supply module.

First of all, the power supply system 1 uses the master power supply module 11 to provide the master power signal to the loading unit 2.

Then performing Step 202: when detecting that the current value of the master power signal increases to a first loading proportion, providing the plurality of slave power signals by the plurality of slave power supply modules.

When the power consumption requirement of the loading unit 2 increases, the current value of the outputting master power signal of the master power supply module 11 will also increase. When the master power detection module 13 detect that the master power signal increases to the first loading proportion, the master micro-controlling module 12 will notice the first slave micro-controlling module 22 and the second slave micro-controlling module 32 via the controlling pin P1, P2, P3, allowing the first slave power supply module 21 and the second slave power supply module 31 to provide the first and second slave power signal together.

Figure 3:
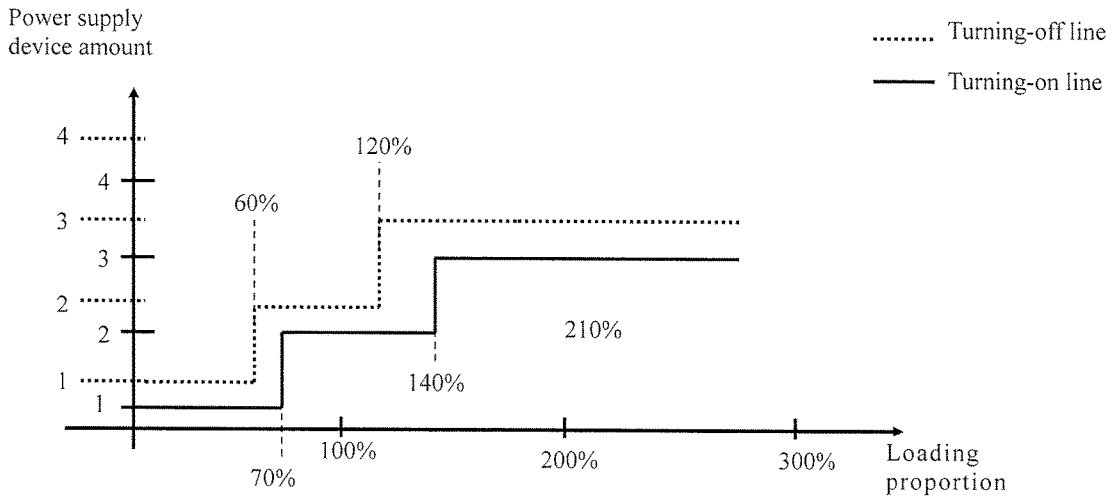
FIG. 3 illustrates a curve graph of the relation between the loading proportion and the power supply device amount in the first embodiment of the present invention.

Please refer to FIG. 3, which illustrates a curve graph of the relation between the loading proportion and the power supply device amount in the first embodiment of the present invention, wherein the solid line represents that the curve line of the loading proportion and the power supply device amount when each power supply devices executes the starting process, the dotted line represents that the curve line of the loading proportion and the power supply device amount when each power supply devices executes the turn-off process.

If a rated current loading of a single power supply module is 100%, when the master power detection module 13 detects that the master power signal increases to 70% of the rated loading, the master micro-controlling module 12 will notice other slave micro-controlling modules to turn on the slave power supply module together.

Then performing Step 203: equalizing the current value of the master power signal and the current value of the plurality of slave power signals.

When the master power supply module 11, the first slave power supply module 21 and the second slave power supply module 31 both provide the power, the master current equalizing module 14, the first slave current equalizing module 24 and the second slave current equalizing module 34 will adjust the master power signal and the plurality of slave power signals, allowing the current value of the master power signal and the plurality of slave power signals to be the same.

Then performing Step 204: according to a time interval, sequentially detecting whether a current value of one of the slave power signals decreases to the second loading proportion.

At the 0.1 second after the first slave power supply module 21 and the second slave power supply module 31 are turned on, the first slave power detection module 23 first determines whether the current value of its outputting first slave power signal decrease to 30% of the rated current loading proportion, which means the current value of the first slave power signal decreases to the second loading proportion.

After the first slave micro-controlling module 22 determines that the current value of the first slave power signal has decreased to the second loading proportion, performing Step 205: turning off the first slave power supply module 21.

Similarly, after another 0.1 second, if the second slave power detection module 33 determines that the current value of its outputting second slave power signal has decreased to 30% of the rated loading, which means the current value of the second slave power signal decreases to the second loading proportion, the second slave micro-controlling module 32 will turn off the second slave power supply module 31. Therefore, the power supply system 1 will be restored to the mode of only using the master power supply module 11 to provide the master power signal.

Besides, the present invention also has a second embodiment. In the second embodiment, the first slave power detection module 23 and the second slave power detection module 33 will automatically detect whether the current value of their own slave power signal respectively decreases to the second loading proportion and the third loading proportion according to the time interval. The third loading proportion is 43.3% of the rated current loading proportion, and the third loading proportion is less than the second loading proportion; for example, the second loading proportion can be 43% of the rated current loading proportion, and the third loading proportion can be 30% of the rated current loading proportion, but the present invention is not limited to that design. In other words, after the first time period, which means at 0.1 second after turning on, if the first slave power detection module 23 detects that the current value of the first slave power signal has decreased to the second loading proportion (43.3%), the first slave micro-controlling module 22 will turn off the first slave power supply module 21, to stop providing the first slave power signal. Then after the second time period, which means after another 0.1 second, if the second slave power detection module 33 detects that the second slave power signal has decreased to the third loading proportion (30%), the second slave micro-controlling module 32 will turn off the second slave power supply module 31, to stop providing the second slave power signal. Therefore, because the determining rated loading are different, the detecting timing (first time period) of the first slave power detection module 23 will be less than the detecting timing (second time period) of the second slave power detection module 33.

Besides, if the power supply system 1 further includes a third slave power supply device, the second loading proportion, the third loading proportion and the fourth loading proportion of the three power supply devices will be different, and they can be in a diminishing relation. For example, the second loading proportion, the third loading proportion, and the fourth loading proportion can respectively be 50%, 43.3%, 30% of the rated current loading proportion, but the present invention is not limited to that proportion relation. In other words, when the plurality of slave power supply devices become to have N slave power supply devices, the first to Nth slave power detection modules still detect if the current value of the first to Nth slave power signals decrease to the (N+1)th loading proportion according to a time interval.

Figure 4:
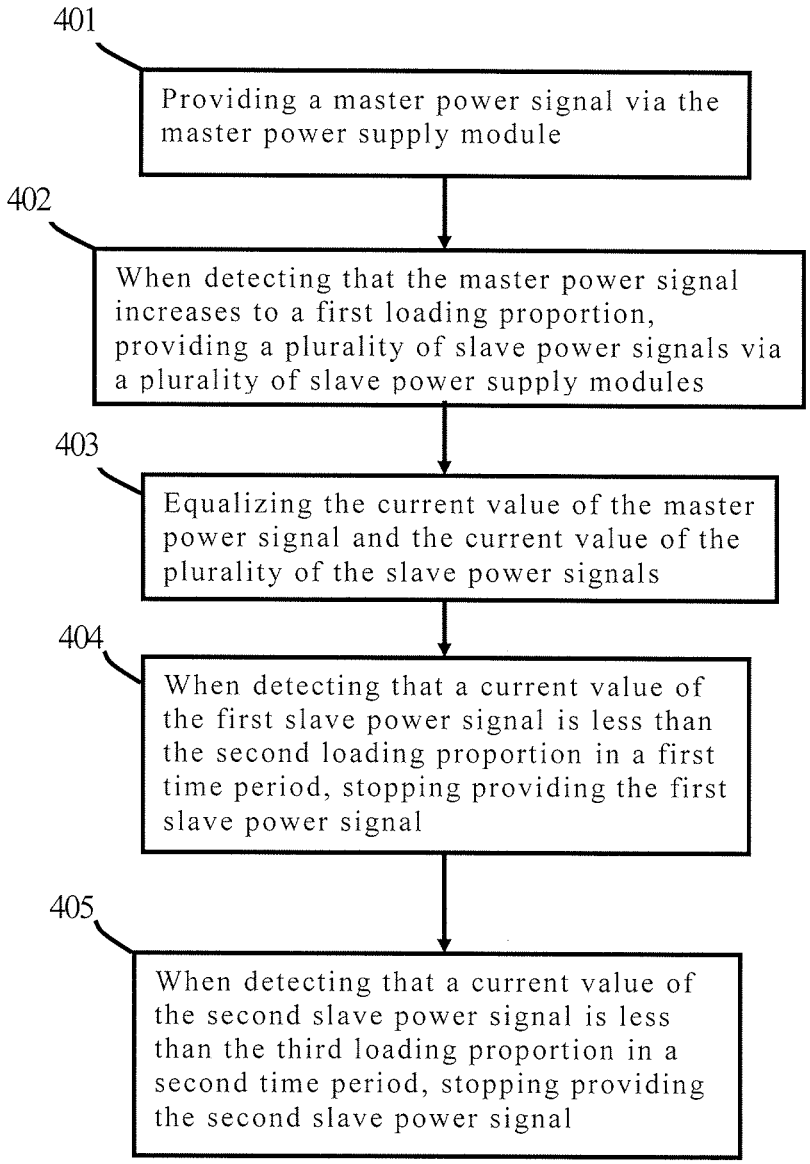
FIG. 4 illustrates a flowchart of the power supply method in the second embodiment of the present invention.

Please refer to FIG. 4, which illustrates a flowchart of the power supply method in the second embodiment of the present invention.

In the second embodiment, first of all, performing Step 401: providing a master power signal via the master power supply module, Step 402: when detecting that the master power signal increases to a first loading proportion, providing a plurality of slave power signals via a plurality of slave power supply modules, and Step 403: equalizing the current value of the master power signal and the current value of the plurality of the slave power signals.

First, the power supply system 1 uses the master power supply module 11 to provide the master power signal to the loading unit 2. When the master power detection module 13 detects that the current value of the master power signal increase to the first loading proportion, the master micro-controlling module 12 will notice the first slave micro-controlling module 22 and the second slave micro-controlling module 32 via the controlling pin P1, P2, P3, allowing the first slave power supply module 21 and the second slave power supply module 31 to provide the slave power signal together, and use the master current equalizing module 14, the first slave current equalizing module 24 and the second slave current equalizing module 34 to make the current value of the master power signal and the plurality of slave power signals be the same. Because Step 401 to 403 are the same as Step 201 to 203, there is no need for furthermore description.

Then performing Step 404: when detecting that a current value of the first slave power signal is less than the second loading proportion in a first time period, stopping providing the first slave power signal.

Figure 5:
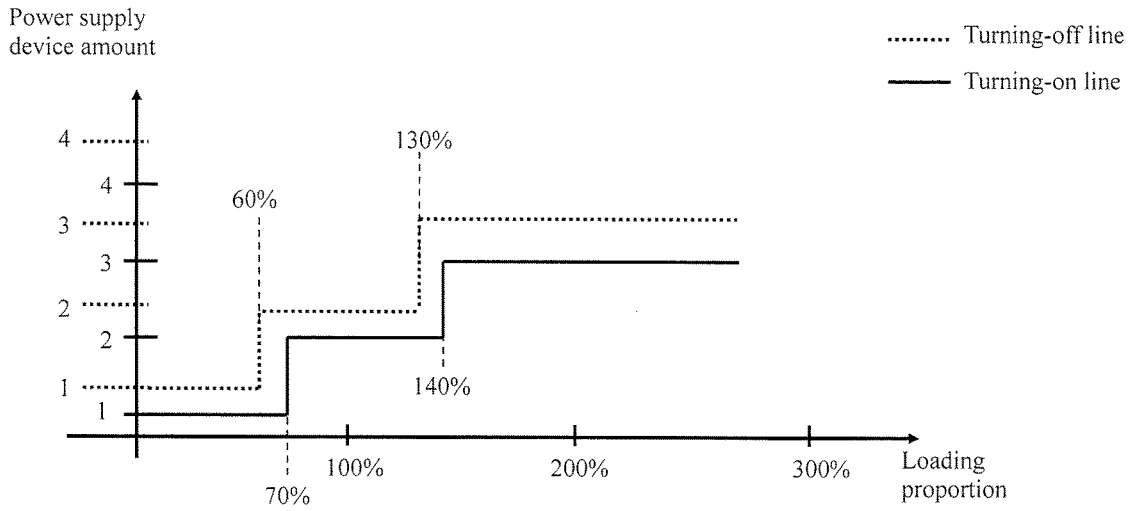
FIG. 5 illustrates a curve graph of the relation between the loading proportion and the power supply device amount in the second embodiment of the present invention.

Please refer to FIG. 5, which illustrates a curve graph of the relation between the loading proportion and the power supply device amount in the second embodiment of the present invention, wherein the solid line represents that the curve line of the loading proportion and the power supply device amount when each power supply devices executes the starting process, the dotted line represents that the curve line of the loading proportion and the power supply device amount when each power supply devices executes the turn-off process.

At 0.1 second after the first slave power supply module 21 is turned on, if the first slave power detection module 23 detects that the current value of the first slave power signal has decreased to the second loading proportion, the first slave micro-controlling module 22 will turn off the first slave power supply module 21. The second loading proportion can be 43.3%.

Finally, performing Step 405: when detecting that a current value of the second slave power signal is less than the third loading proportion in a second time period, stopping providing the second slave power signal.

After a second time period, such as at 0.2 second after starting, if the second slave power detection module 33 detects that the current value of the second slave power signal has decreased to the third loading proportion, the second slave micro-controlling module 32 will turn off the second slave power supply module 31, wherein second loading proportion can be 30%.

It is to be known that, the power supply method of the present invention is not limited to the abovementioned step order, the step order can be changed if the object of the present invention can be achieved.

Via the power supply system 1 and the power supply method of the present invention, the whole power supply devices of the power supply system 1 can be adjusted flexibility according to the requiring loading current, to effectively keep the power supply system 1 in the best working interval.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope of the invention.

What is claimed is:

1. A power supply system, used for outputting a total power signal, the power supply system comprising:

a master power supply device, comprising:

a master power supply module, used for providing a master power signal;

a master micro-controlling module, electrically connected to the master power supply module, used for controlling the master power supply module;

a master power detection module, electrically connected to the master power supply module, for detecting a current value of the master power signal; and a master current equalizing module, electrically connected to the master power supply module; and a slave power supply device, comprising:

a slave power supply module, used for providing a slave power signal;

a slave micro-controlling module, electrically connected to the master micro-controlling module via a controlling pin, for controlling the slave power supply module;

wherein when the master power detection module detects that the current value of the master power signal increases to a first loading proportion, the master micro-controlling module notices the slave micro-controlling module via the controlling pin, allowing the slave power supply module to provide the slave power signal;

a slave power detection module, electrically connected to the slave power supply module, for detecting a current value of the slave power signal; wherein when the slave power detection module detects that the current value of the slave power signal decrease to a second loading proportion, the slave micro-controlling module controls the slave power supply module to stop providing the slave power signal; and a slave current equalizing module, electrically connected to the slave power supply module and the master current equalizing module; wherein the master current equalizing module and the slave current equalizing module are used for equalizing the current value of the master power signal and the current value of the slave power signal.

2. The power supply system as claimed in claim 1, wherein the first loading proportion is 70% of a rated current loading proportion.

3. The power supply system as claimed in claim 1, wherein the power supply system comprises a plurality of slave power supply devices, wherein any one slave power detection module of the plurality of slave power supply devices sequentially detects whether the current value of one of the slave power signals decreases to the second loading proportion according to a time interval; if yes, allowing one of the slave micro-controlling modules to turn off one of the slave power supply modules.

4. The power supply system as claimed in claim 3, wherein the second loading proportion is 30% of the rated current loading proportion.

5. The power supply system as claimed in claim 1, wherein the power supply system comprises a first slave power supply device and a second slave power supply device, used for respectively providing a first slave power signal and a second slave power signal; wherein:

when a first slave power detection module of the first slave power supply device detects that a current value of the first slave power signal is less than the second loading proportion in a first time period, a first slave micro-controlling module of the first slave power supply device turns off a first slave power supply module; and when a second slave power detection module of the second slave power supply device detects that a current value of the second slave power signal is less than a third loading proportion in a second time period, a second slave micro-controlling module of the second slave power supply device turns off a second slave power supply module; wherein the second loading proportion is more than the third loading proportion, and the first time period is less than the second time period.

6. The power supply system as claimed in claim 5, wherein the second loading proportion is 43.3% of the rated current loading proportion, and the third loading proportion is 30% of the rated current loading proportion.

7. The power supply system as claimed in claim 5, wherein the first time period is 0.1 second, and the second time period is 0.2 second.

8. A power supply method, applied to a power supply system for outputting a total power signal; wherein the power supply system comprises a master power supply module and a slave power supply module; the power supply method comprising:

providing a master power signal by the master power supply module;

when detecting that the master power signal increases to a first loading proportion, providing a slave power signal by the slave power supply module;

equalizing a current value of the master power signal and a current value of the slave power signal; and when detecting that the current value of the plurality of slave power signals decreases to a second loading proportion, stopping the slave power supply module providing the slave power signal.

9. The power supply method as claimed in claim 8, wherein the power supply system comprises a plurality of slave power supply modules, for providing a plurality of slave power signals, the power supply method further comprising:

according to a regular time interval, sequentially detecting whether a current value of one of the slave power signals provided by the plurality of slave power supply modules decreases to the second loading proportion; and if yes, stopping one of the plurality of slave power supply modules providing the slave power signal.

10. The power supply method as claimed in claim 8, wherein the power supply system comprises a first slave power supply module and a second slave power supply module, for respectively providing a first slave power signal and a second slave power signal; the power supply method further comprising:

when detecting that a current value of the first slave power signal is the second loading proportion of the total power signal in a first time period, stopping providing the first slave power signal; and when detecting a current value of the second slave power signal is the third loading proportion of the total power signal in a second time period, stopping providing the first slave power signal; wherein the second loading proportion is more than the third loading proportion, and the first time period is less than the second time period.

* * * * *